United States Patent [19]

Dubé

[11] Patent Number: 4,470,846

[45] Date of Patent: Sep. 11, 1984

[54] REMOVAL OF ALKALI METALS AND ALKALINE EARTH METALS FROM MOLTEN ALUMINUM

[75] Inventor: Ghyslain Dubé, Jonquiere, Canada

[73] Assignee: Alcan International Limited, Montreal, Canada

[21] Appl. No.: 456,271

[22] Filed: Jan. 6, 1983

Related U.S. Application Data

[63] Continuation-in-part of Ser. No. 265,254, May 19, 1981, abandoned.

[51] Int. Cl.[3] ..... C22B 21/06

[52] U.S. Cl. ..... 75/68 R; 75/93 AC; 266/235

[58] Field of Search ..... 75/68 R, 93 R, 93 AC; 266/233, 235

[56] References Cited

U.S. PATENT DOCUMENTS

| | | | |
|---|---|---|---|
| 3,436,212 | 4/1969 | Hess | 75/68 R |
| 3,620,716 | 11/1971 | Hess | 75/68 R |
| 4,322,245 | 3/1982 | Claxton | 75/68 R |

FOREIGN PATENT DOCUMENTS

| | | | |
|---|---|---|---|
| 1367069 | 9/1974 | United Kingdom | 75/68 R |

*Primary Examiner*—M. J. Andrews

*Attorney, Agent, or Firm*—Cooper, Dunham, Clark, Griffin & Moran

[57] ABSTRACT

A method of removing dissolved contaminant alkali metals and alkaline earth metals from molten aluminum by reaction of the contaminants with solid particulate aluminum-fluoride-yielding material, wherein a body of the molten aluminum to be decontaminated is stirred, in the presence of the aluminum fluoride particles, in such manner as to generate and maintain a stable vortex in the molten body.

20 Claims, 6 Drawing Figures

Fig. 3.
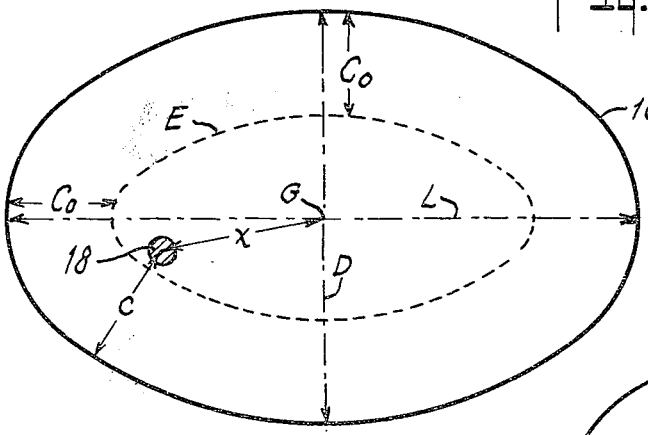
Fig. 4.
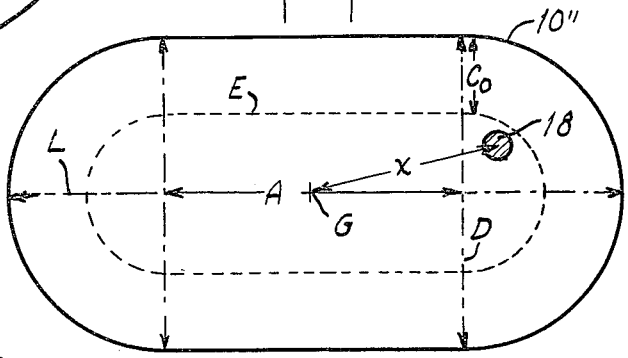
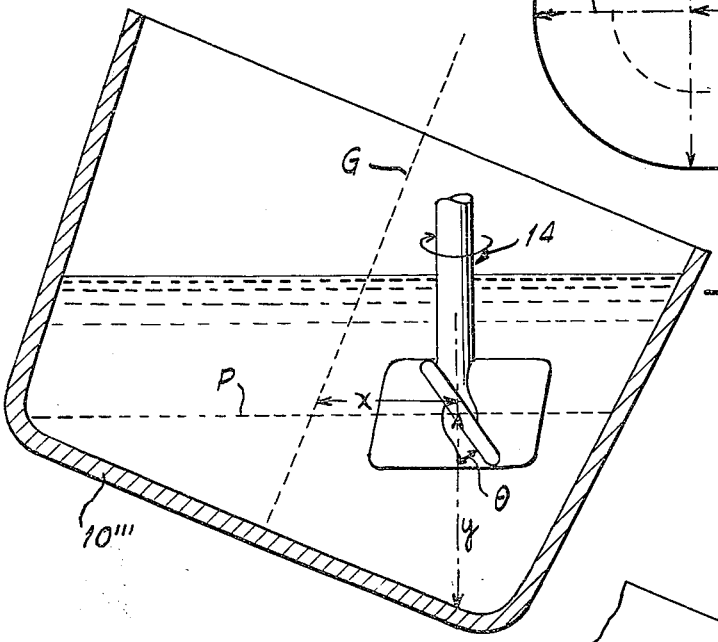
Fig. 5.
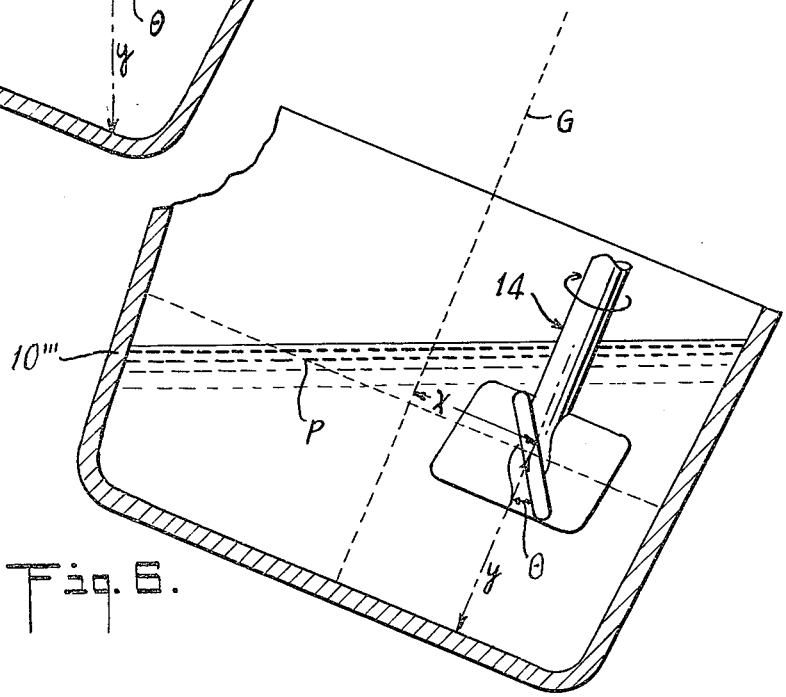
Fig. 6.

REMOVAL OF ALKALI METALS AND ALKALINE EARTH METALS FROM MOLTEN ALUMINUM

CROSS REFERENCE TO RELATED APPLICATION

This application is a continuation-in-part of applicant's copending U.S. patent application Ser. No. 265,254, filed May 19, 1981, for "Removal of Alkali Metals and Alkaline Earth Metals from Molten Aluminum," now abandoned.

BACKGROUND OF THE INVENTION

This invention relates to the removal of contaminant quantities of alkali metals and alkaline earth metals from molten aluminum. In particular, it is directed to methods for removing such contaminants from molten aluminum by reaction with aluminum fluoride.

Molten primary aluminum (i.e. aluminum metal as withdrawn from electrolytic reduction cells wherein it is produced) contains small amounts of alkali metals such as lithium and sodium and alkaline earth metals such as magnesium and calcium, dissolved in the molten aluminum, and derived either from the charge of alumina to the cell, from the electrolyte of the cell, or from the carbonaceous anode material of the cell, or (in the case of lithium) from lithium compounds deliberately added to the cell to improve cell operation. The presence of these contaminant alkali metals and alkaline earth metals in concentrations exceeding about 1 or 2 parts per million (p.p.m.) is deleterious for various uses to which the primary metal may be put.

For example, in the production of magnesium-containing aluminum alloy sheet or plate, sodium when present in amounts of approximately 2 p.p.m. or more can cause hot shortness or edge cracking during hot rolling. In molten metal handling and casting, the presence of trace quantities of lithium and/or sodium increases the rate of oxidation of aluminum in air, with the effect of increasing the melt loss and generating a thick dross layer which can block casting machine nozzles and the like and diminish metal fluidity. Therefore, economic and technical considerations require that these elements be removed as soon as possible after withdrawal of primary aluminum from the reduction cells to reduce the time period during which lithium and/or sodium-containing molten aluminum is exposed to the atmosphere. Magnesium in small quantities is detrimental to electrical conductivity and should be removed from primary aluminum which is to be used for products in which this property is important. In the production of lacquered strip or foil, the presence of 1–2 p.p.m. lithium in magnesium-containing aluminum alloys can result in poor adhesion of lacquer or corrosion of foil. Lithium alone in commercial purity aluminum or alloys can cause what is known as "blue corrosion."

Accordingly, it has been recognized as desirable to remove contaminant alkali metals and alkaline earth metals from molten primary aluminum, at least to the extent of reducing their concentrations each to about 1 or 2 p.p.m. or preferably even less than 1 p.p.m. Such removal is also desirable in other circumstances where aluminum or an aluminum-based alloy (the term "aluminum" being used herein broadly to embrace these alloys as well as pure aluminum metal) is contaminated with minor amounts of one or more alkali metals and/or alkaline earth metals.

It is known that the content of dissolved alkali metals and/or alkaline earth metals, in molten aluminum contaminated therewith, can be reduced by bringing the contaminated molten aluminum into contact with a material in solid state comprising aluminum fluoride ($AlF_3$), for reaction of the contaminant element or elements with the aluminum fluoride to form mixed compounds (e.g. cryolithionite compounds such as $3LiF.3NaF.2AlF_3$) which can be removed from the molten metal surface by skimming, or which are otherwise readily separable from the molten aluminum. Typically, the material comprising aluminum fluoride is brought into contact with the molten aluminum in particulate form. This material may consist essentially of aluminum fluoride, or may be composed wholly or in part of alkali metal fluoaluminates which are solid at the temperature of the molten metal. An example of the latter type of material (useful for removal of lithium, magnesium, and calcium) is particulate sodium cryolite or lithium-free reduction cell electrolyte having a low ratio of sodium fluoride to aluminum fluoride so as to contain aluminum fluoride in excess of the stoichiometric requirements of $Na_3AlF_6$ with a composition such that a major proportion remains solid at the treatment temperature, as is usually the case provided the aforementioned ratio remains within the range of 1.3–1.5. Indeed, it is not essential that the addition remain in solid form; a low (approximately 725° C.) melting-temperature compound containing a large excess of $AlF_3$ (e.g. having a very low $NaF:AlF_3$ ratio of 0.6–0.7) which melts on introduction to molten aluminum would be equally effective in removing alkali metals or alkaline earth metals. The active fluoride material may also contain inert material such as aluminum oxide, in a proportion even as high as 50% by weight, although 7–20% is the more usual aluminum oxide content of commercial aluminum fluoride.

Procedures utilizing material comprising aluminum fluoride, as described above, are considered advantageous for removal of alkali metals and alkaline earth metals, as compared with the alternative technique of treating the contaminated molten aluminum by fluxing with pure chlorine gas or a mixture of inert gas and chlorine using an in-line treatment unit equipped with rotating gas-dispersing stirrers, because the gas fluxing operations yield deleterious gaseous by-products and are otherwise inconvenient.

Heretofore, as disclosed, for example, in U.S. Pat. Nos. 3,305,351, 3,528,801, and 4,138,246, removal of contaminant dissolved alkali metals and/or alkaline earth metals from molten aluminum with material comprising aluminum fluoride has been effected by passing the molten aluminum through a packed filter bed containing a particulate material comprising aluminum fluoride, alone or in mixture with carbonaceous material such as coke. In U.S. Pat. No. 4,277,280, a similar effect is achieved by passing molten aluminum through a reactive bed of coarse granular $AlF_3$-containing material which is not a filter. However, the use of reactive beds or bed filters comprised of reactive materials has several disadvantages. In the first place, aluminum fluoride material is a poor filter medium owing to its high friability and, for this reason, has a strong tendency to clog the reactive bed. Additionally, a substantial proportion of the products of reaction of the alkali metal (Li, Na, Mg) with aluminum fluoride remains trapped within the filter material and by decreasing the void fraction of the bed tends to cause premature plugging of the filter; electrolytic bath from the reduction cell, sludge and/or other solid or liquid impurities carried over during the hot metal transfer from the cell have the same effects. For similar reasons, a preferential metal path or "channel" can appear within the bed and seriously reduce the alkali metal removal efficiency of the filter. Furthermore, since the aluminum fluoride material is consumed during the filtration of molten metal (with resultant decrease in efficiency of removal of alkali metals), the performance of a filter bed is not constant during its service life. Again, to prevent aluminum fluoride pyrohydrolysis and metal losses, it is preferable to keep aluminum fluoride always completely submerged in liquid aluminum; but this requires a constant heating fuel consumption, even when the filter installations are not operating, which adds to the cost of the treatment. The change of alloys through such a system is invariably associated with metal losses. Also, during initial preheating of the $AlF_3$ bed, decomposition by pyrohydrolysis (i.e. reaction with moisture in combustion products) tends to occur, which shortens the effective life of the bed and is often responsible for environmental pollution problems owing to the release of hydrogen fluoride gases.

Apart from the use of a packed filter bed or other reactive bed, it has been difficult to achieve effective contact between solid particulate material comprising aluminum fluoride and contaminated molten aluminum metal. The reasons for this are, first, that liquid aluminum has a high surface tension (900 dynes/cm at 700° C., 865 dynes/cm at 800° C.); second, that the difference in density between aluminum fluoride powder and molten aluminum is very small (the density of molten aluminum is 2.37 g/cm$^3$ at 700° C., 2.33 g/cm$^3$ at 800° C., and 2.29 g/cm$^3$ at 900° C., while the real density of aluminum fluoride is 2.8 g/cm$^3$ and its bulk density is about 1.3–2.0 g/cm$^3$) so that in practice, $AlF_3$ powder will float on the surface of liquid aluminum; third, that aluminum fluoride powder is not easily wetted by liquid aluminum; and fourth, that aluminum fluoride material is thermally very stable, i.e. it does not melt under atmospheric pressure, and it has a sublimation temperature of approximately 1,270° C., so that reaction between liquid-liquid or gas-liquid phases is impossible at the temperature of molten aluminum (660° C.–900° C.). These physical characteristics explain the poor performances of previous attempts to introduce particulate aluminum fluoride into molten aluminum, because the particles of aluminum fluoride remained on the surface of the liquid metal, which they barely contacted, and remained at a relatively low temperature.

It is possible to inject a stream of finely divided aluminum fluoride particles beneath the surface of a molten aluminum body by entraining them in a jet of carrier gas such as air or nitrogen which is delivered to the molten metal body through an injection lance. Injection operations, however, have been found to require substantial periods of time, and there are safety hazards associated with the high gas pressure in the metal; in addition, use of air as the injecting gas can lead to excessive dross and oxide film formation. It is also possible to make a large addition of aluminum fluoride powder to the bottom of an empty crucible before metal addition. However, it has been observed that the aluminum fluoride powder reacts preferentially with the electrolyte (which is invariably siphoned from the reduction cell along with the metal) to form a solid mass which remains attached to the crucible lining. Thus effective contact with the molten aluminum is prevented.

As will be understood from the foregoing discussion, a substantial contact time is required for efficient reaction between loose particulate aluminum fluoride-containing material and alkali metal and alkaline earth metal contaminants in molten aluminum metal.

SUMMARY OF THE INVENTION

The present invention broadly contemplates the provision of a method of removing contaminant alkali metals and alkaline earth metals from aluminum by bringing the aluminum, in molten state, into contact with particulate aluminum-fluoride-yielding material, including the steps of delivering the particulate material to the surface of a body of the molten aluminum and stirring the molten body for creating and maintaining a vortex therein to draw the delivered particulate material into mixture with the molten aluminum, thereby to effect reaction of the aluminum fluoride with the contaminants.

In this method, the particles of aluminum-fluoride-yielding material, which are gravity-fed onto the surface of the molten metal, are drawn into the vortex where they react with the contaminant alkali metals and/or alkaline earth metals dissolved in the molten aluminum. The excess aluminum fluoride (i.e. that not initially consumed by such reaction) is continuously recirculated from the bottom of the vortex through the body of molten metal to the surface at an upper level in the melt, where it is again continuously drawn into the vortex. This recirculation, combined with the strong agitation of the molten metal produced by the stirring action, ensures efficient contact between the solid aluminum-fluoride-yielding material and the molten aluminum. It is at present believed that stirring action providing axial (downward) as well as lateral (radial) components of liquid flow is especially important to ensure effective penetration of the liquid metal by the particulate aluminum-fluoride-yielding material. It is also believed at present that improved heat transfer between the molten metal and the aluminum-fluoride-yielding material occurs in the vortex. The material in the vortex is believed to comprise a low melting point compound of aluminum fluoride and alkali or alkaline earth metals. This material is believed to partially fuse in the vortex and so help to increase contact between aluminum fluoride-rich phases and molten aluminum to achieve the observed fast and efficient reaction rate. This thorough mixing and rapid reaction is achieved without resort to gas injection.

The aluminum-fluoride-yielding material used in the method of the invention can be material comprising aluminum fluoride (as defined above), viz. material consisting essentially of or containing aluminum fluoride and/or composed wholly or in part of alkali metal fluoaluminates. Alternatively, it can consist of or comprise any active fluorine-containing compound which on addition to molten aluminum will liberate a fluoride which is reactive toward alkali metal or alkaline earth metal contaminants and which does not introduce other undesirable contaminants into the molten aluminum; $KBF_4$ and $K_2TiF_6$ are examples of such compounds. It can be a mixture of fluorides, and can contain a proportion of inert material as discussed above. All the foregoing are embraced within the term "aluminum-fluoride-yielding material" herein, it being understood that the use of any particular one of these aluminum-fluoride-yielding materials is not in itself a feature of the present invention.

Thus, the method of the invention requires the addition of an appropriate charge of the treatment material (aluminum fluoride or aluminum fluoride-yielding material) to the molten aluminum metal under conditions which involve recirculation of the treatment material within the molten metal while avoiding excessive disturbance of the molten metal surface, to hold down oxidation of the metal. In the method of the invention the treatment material is entrained in the molten aluminum by supplying the treatment material to a vortex generated in a body of the molten metal held within a container. The vortex generator also serves to generate upwardly spiralling currents in the molten metal in the region of the boundaries of the container to maintain prolonged contact of the particles of the treatment material with the molten metal. The circulation of the molten metal by vortex generation is continued for a sufficient length of time to reduce the alkali metal and alkaline earth metal content of the molten metal at least to a predetermined desired low value, after which the circulation is discontinued. Some of the reaction products, which are admixed with residual treatment material, will rise to the surface as a dross, from which the molten metal can be separated by dross skimming or metal siphoning or other conventional means. However, the greater part tends to adhere to the crucible lining during the stirring process, whence it can be removed when the crucible is empty.

It is well known in metallurgical processes to introduce reactive materials into molten metal vortices, generated in vessels from which the molten metal is discharged as a continuous stream. In the present procedure, generation of a vortex serves both as a means for bringing a finely powdered particulate material of relatively low bulk density into contact with molten metal and as a means for maintaining the particles of such material dispersed within the molten metal and in intimate contact therewith over an extended period until generation of the vortex is terminated.

The stirring step of the invention, as broadly set forth above, may be performed in any manner that generates and maintains a vortex in a molten metal; for example, electromagnetic induction stirring may be employed using appropriately arranged induction coils disposed externally of a crucible or other vessel containing the molten metal and suitably energized.

In preferred embodiments, however, the vortex is generated and maintained by using a rotating stirrer having a rotor comprising plural blades immersed within a body of molten metal contained in a crucible, with the blades pitched so that each blade has a major surface facing downwardly at an acute angle to the axis of rotation of the rotor (and with the direction of rotation such that the downwardly-facing blade surfaces are the leading surfaces of the blades), and/or with the impeller so disposed in the crucible that the axis of rotation of the stirrer is eccentric with respect to the center line of the crucible. Preferably the axis of rotation of the rotor is vertical. It is especially preferred to use a pitched-bladed impeller as described and to dispose the impeller eccentrically of the crucible center line. This arrangement is found to generate a particularly stable vortex with an advantageous combination of axial and radial flow components affording superior penetration of the solid fluoride particles into the molten metal.

The invention in a further sense embraces the provision of apparatus for mixing particulate aluminum-fluoride-yielding material with molten aluminum, including a crucible for the molten metal, and an impeller or rotor having pitched blades as described above and disposed eccentrically of the center line of the crucible, with various dimensional and positional relationships maintained within specified ranges or limits described below.

Further features and advantages of the invention will be apparent from the detailed description hereinbelow set forth, together with the accompanying drawings.

BRIEF DESCRIPTION OF THE DRAWINGS

FIG. 3 is a diagrammatic sectional view, in the plane of stirrer rotation, of a crucible having an elliptical cross section in that plane;

FIG. 4 is a similar diagrammatic sectional view of a crucible having a parallel-sided cross section with semicircular ends in the plane of stirrer rotation;

FIG. 5 is a simplified elevational view, similar to FIG. 1, of a tilted crucible having downwardly tapering walls, with a stirrer rotating about a vertical axis; and FIG. 6 is a similar view of the tilted crucible of FIG. 5 but with the stirrer rotating about a tilted axis.

DETAILED DESCRIPTION

Figure 1:
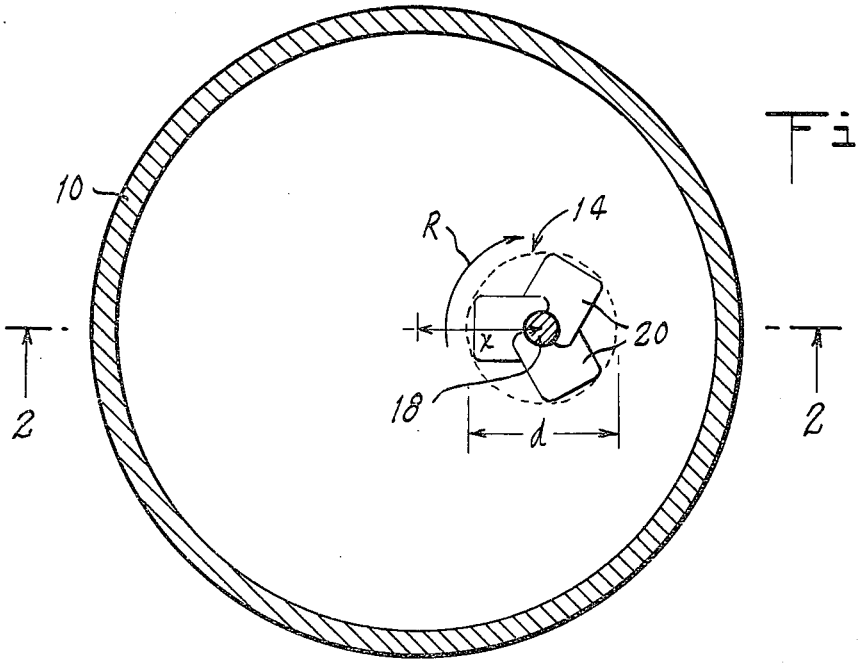
FIG. 1 is a simplified and somewhat schematic sectional plan view of apparatus for performing the method of the invention in an illustrative embodiment, using a crucible with a cylindrical internal wall and a vertical geometric axis.
Figure 2:
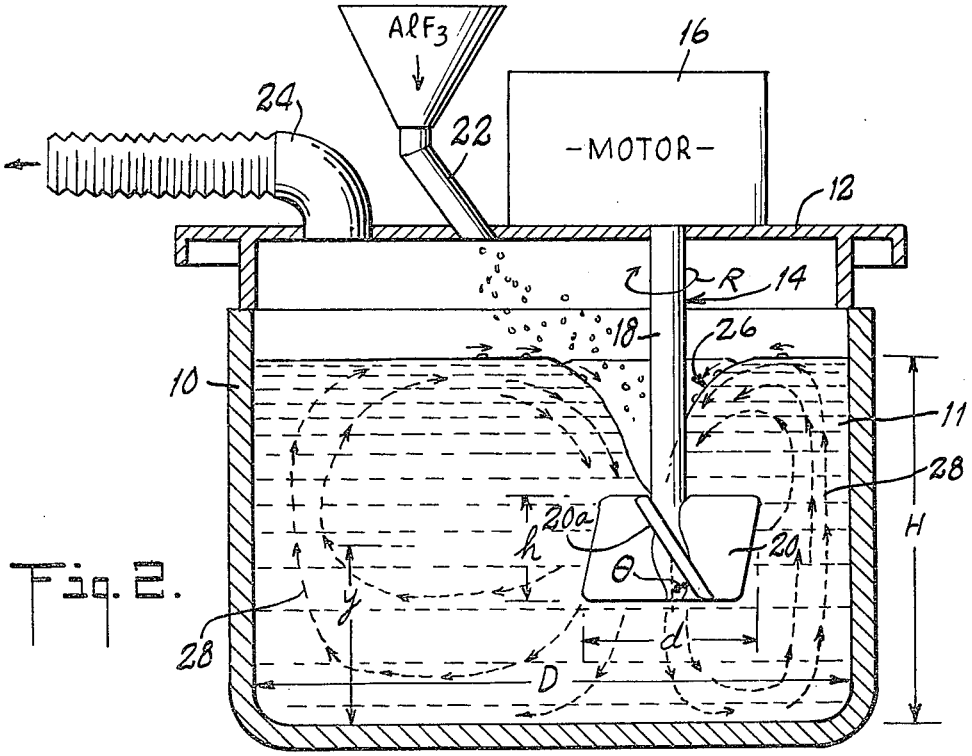
FIG. 2 is an elevational sectional view taken as along the lines 2—2 of FIG. 1 and illustrating the performance of the present method.

Referring first to FIGS. 1 and 2, the method of the invention will be described as practiced in apparatus including a crucible 10 (shown as generally cylindrical, about a vertical axis) for containing a body of molten aluminum 11; a lid 12 for closing the upper open end of the crucible; an impeller or rotor 14 driven by a motor 16 for rotation about a vertical axis and having a vertical shaft 18 depending from the lid into the crucible with blades 20 secured to the lower portion of the shaft for immersion in the molten aluminum body 11; a duct 22 for admitting particulate aluminum-fluoride-yielding material to the crucible; and an exhaust conduit 24 for withdrawing fumes from the crucible. Typically, the crucible is made of steel, with a refractory lining that is inert to molten aluminum, so that the crucible is capable of withstanding the conditions to which it is exposed without significantly contaminating the contained metal. The impeller 14 with its motor 16, the duct 22, and the conduit 24 are mounted on the lid 12, which may be lifted (by suitable means, not shown) from its illustrated, closed position to an upper, open position for access to the crucible interior and to permit the same stirring apparatus to be used to stir molten metal in a succession of different mobile crucibles. As hereinafter further explained, the impeller blades are disposed to be fully immersed in the molten aluminum body 11 and are shaped, dimensioned and positioned to generate and maintain a stable vortex in the molten body.

In the practice of the present method using the above-described apparatus, for removal of contaminant, dissolved alkali metals and/or alkaline earth metals from molten aluminum, the crucible 10 is filled (to a level somewhat below its upper edge) with the contaminated molten aluminum, to provide therein a molten body 11 having substantial depth. The lid 12 is then lowered to seat on and close the crucible and to immerse the bladed portion of the impeller 14 in the molten body. Particulate aluminum-fluoride-yielding material, e.g. material comprising or consisting of aluminum fluoride ($AlF_3$), is then fed by gravity through the duct 22 so as to fall on the surface of the molten body 11, where it tends to float, since it is not easily wetted by molten aluminum. The motor is operated to drive the impeller at a rate and in a direction of rotation at which the impeller generates and maintains a stable vortex (indicated at 26 in FIG. 2) in the molten body 11, producing therein a combination of axial and radial flow components such that the aluminum fluoride particles are drawn into the vortex and then circulated through the molten body along flow paths generally indicated at 28. The aluminum fluoride particles may be delivered prior to the start of impeller rotation, or the feed of the particles may be continued (e.g. in successive increments) while the impeller is rotating. It is not necessary to add aluminum fluoride directly into the vortex, since the material will be rapidly moved thereto by the high rate of metal circulation at the melt surface.

Rotation of the impeller is continued, with maintenance of the vortex 26 and continuing recirculation of the aluminum fluoride particles through the molten body, until there has been sufficient reaction between the aluminum fluoride and the dissolved contaminant alkali metals and/or alkaline earth metals to reduce the content of these contaminants in the melt at least to a predetermined desired low value. Typically, the time required to achieve this result, measured from the onset of impeller rotation, is no more than about ten minutes, and indeed often substantially less than ten minutes. Gas or fume generated incident to performance of the method is discharged through the conduit 24. Compounds produced by reaction of the contaminant alkali metals and alkaline earth metals with the aluminum fluoride such as cryolithionite compounds float on the surface of the molten body, and may be readily removed by skimming when the rotation of the impeller is ended and the lid is lifted away from the crucible. The decontaminated molten metal may then be poured or otherwise withdrawn from the crucible.

By this method, it is possible to reduce the level of contaminants in a body of molten aluminum (e.g. initially containing about 20 p.p.m. lithium and about 30–60 p.p.m. sodium) to less than 1 p.p.m. each within a period of ten minutes or less of continuous stirring with the impeller. Since some reduction in the levels of these contaminants occurs inherently during the performance of other steps commonly employed in handling molten aluminum (including such operations as siphoning, skimming, addition of alloying elements, stirring, chlorine purging, etc.), however, it is frequently possible to achieve satisfactory reduction in content of the contaminant metals (to a level of, e.g., 2 p.p.m. Li) with even shorter periods of impeller operation. Even though the aluminum fluoride may contain a proportion of alumina, the fluxing action of the fluoride serves to remove the insoluble material, such that no harm arises from its introduction to the melt. In fact, it is observed that the process of the invention has the incidental effect of removing inclusion-forming materials, such as aluminum carbide ($Al_4C_3$), which were present in the melt before treatment.

In the illustrated embodiment of the invention, and in accordance with present preference, the optimum combination of axial and radial flow components for attaining a high mixing efficiency of the solid $AlF_3$ particles into the molten aluminum (with resultant rapid and continuing removal of contaminant alkali metals and alkaline earth metals) is achieved by appropriate disposition of the impeller relative to the crucible and/or by the dimensions and design of the impeller blade and the direction of impeller rotation. To this end, stated in general, the impeller comprises a plurality of equiangularly spaced, pitched blades 20 each having a major surface 20*a* that faces downwardly at an acute angle to the vertical; the axis of the impeller shaft (i.e. the vertical axis of impeller rotation) is disposed eccentrically of the geometric axis of the crucible, and the direction of impeller rotation is such that the blade surfaces 20*a* are the leading surfaces of the blades, exerting on the molten aluminum a force having a downward component. To assist in specific description of the pertinent dimensional and other features of impeller structure and disposition, further reference may be made to FIGS. 1 and 2 of the drawing, wherein $\theta$ designates the pitch angle of the blade surfaces 20*a*, d designates the overall diameter of the bladed portion of the impeller, h designates the height of the impeller blades, x designates the eccentricity of the impeller (distance of the impeller axis from the vertical geometric axis of the cylindrical crucible), y designates the vertical distance from the bottom of the crucible interior to the midpoint of the impeller blades, H designates the vertical distance from the bottom of the crucible interior to the quiescent level of molten metal in the crucible, D is the internal diameter of the crucible, and the arrow R represents the direction of impeller rotation.

In accordance with the invention, as particular or preferred features thereof, the following ranges of relationships and dimensions are observed in the design and disposition of an impeller of the illustrated type for use with a crucible having an axially vertical cylindrical inner wall:

| Relationship or dimension | Outside range | Preferred Range |
|---|---|---|
| d/D | 0.1–0.6 | 0.15–0.40 |
| h/H | 0.1–0.7 | 0.2–0.40 |
| x | 0–D/4 | 0–d/2 |
| y | 0.25H–0.75H | 0.4H–0.6H |
| $\Theta$ | 0°–45° | 30°–40° |

wherein at least one of x and $\theta$ are greater than zero, and R has the direction indicated in the drawing with respect to the sense or orientation of the pitch of the blades. It is especially preferred to utilize three blades spaced 120° apart with a pitch angle of 30°–35°, and a ratio d/D of about 0.25.

The described impeller arrangement is advantageous in creating a stable vortex without resort to use of vertical baffles as has heretofore been customary for generation of a vortex in a vessel of circular cross-section. Thus, the present arrangement can be employed to stir molten metal in a mobile crucible (e.g. a transfer crucible), in which the provision of temporary baffles would be complicated and time-consuming, and the presence of permanent baffles would interfere with maintenance and mechanized cleaning of the crucible. The function of conventional baffles in maintaining a high rate of relative rotation between the impeller and the liquid being stirred is achieved with the present impeller arrangement by the combination of radial and axial flow components produced by the impeller, while the effect of the baffles in stabilizing vortex volume and minimization of surface waves and liquid level oscillations can be obtained by observance of appropriate design and operating criteria including the ranges specified above and the rate of impeller rotation.

It is preferred to utilize an impeller having three blades spaced 120° apart, as providing optimum performance from the standpoint of mixing and stability, although a smaller number (two) or larger number (four or more) may be employed, so long as they create a deep, stable vortex with good axial metal circulation to insure rapid and constant fluoride particle penetration and recirculation through the molten aluminum; however, impellers with more than four blades are not preferred, for reasons of mechanical complexity, cost, and tendency to become clogged, with resultant impairment of efficiency.

Since blade pitch angles $\theta$ as large as 45° or more tend to cause splashing and surface waves, it is preferred to use a smaller pitch angle. Nevertheless, the provision of a substantial pitch angle (30°–35°) is preferred (over an impeller with vertical blades) to force metal circulation under the impeller, as a metal flow having a vertical (axial) component drags the fluoride powder through the molten aluminum much more efficiently than is possible with vertical (0° pitch) blades. Moreover, when an impeller with vertical blades is rotated in the center of a crucible, the aluminum fluoride material tends to stick together around the impeller and impeller shaft, reducing the effective solid-liquid contact surface area and thereby markedly decreasing the efficiency of contaminant (alkali and alkaline earth) metal removal.

The requisite axial component of molten metal flow can also be achieved, even with a vertical-bladed impeller, by locating the impeller eccentrically with respect to the geometric axis of the crucible. In the case of a pitched-bladed impeller, as well, such eccentric positioning of the impeller is highly desirable, in order to minimize metal waves and oscillations at the surface of the metal; the axial flow component obtained in the off-centered location of the impeller reduces the tangential speed of the metal between the crucible walls and the stirrer and eliminates metal tossing, while the stirrer shaft acts as a baffle in breaking surface metal waves. This is especially important from the standpoint of safety during the stirring of metal in transfer crucibles of large size.

The minimum rate of rotation, for a given impeller, is that which will generate and maintain a stable vortex, while the maximum rotation rate is that above which air is ingested into the molten body being stirred. These values are determined by the impeller diameter d. The optimum rotation rate is that which produces a good vortex without causing excessive metal splashing and loss or being responsible for either crucible refractory or impeller construction material erosion. Referring to an impeller providing a d/D ratio within the preferred range of 0.15–0.40, it is at present preferred to operate such an impeller at a rotation rate of about 100 to about 300 r.p.m., rates within this range being sufficient to generate and maintain the requisite vortex yet not so rapid as to cause undesired splashing of molten metal. However, rates of rotation outside this range may also be used, so long as they produce the desired vortex without excessive splashing. The use of an eccentrically disposed impeller having tilted or pitched blades rotated in the above-defined direction is found to be especially satisfactory in generating the stable vortex with a highly effective combination of axial and radial flow components for enhancing penetration of the solid aluminum fluoride particles into the molten metal.

During the treatment of molten aluminum with $AlF_3$ powder, alkali and alkaline earth metals react preferentially with $AlF_3$ (compared to aluminum) to form mixed alkali cryolithionite compounds, e.g. $Na_5Al_3F_{14}$, $Na_2LiAlF_6$, and $Li_3Na_3Al_2F_{12}$. These compounds, having a relatively low melting point (compared with pure cryolite), can easily be agglomerated or stick to the crucible walls or float to the melt surface where they react with metal oxide or particles of electrolyte always present after the siphoning of electrolytic cells. During subsequent metal transfer by siphoning, most of these compounds will remain inside the crucible.

Although a high grade of $AlF_3$ is desirable for a fast reaction with alkali, a higher ratio of $AlF_3/Al$ could compensate for a lower-grade powder. Other mixtures which could be used are lower-grade $AlF_3$ (e.g. $AlF_3$ mixed with $Al_2O_3$) or electrolytic bath material containing a large excess of $AlF_3$ (i.e. $Na_3AlF_6$ with excess $AlF_3$).

The dimensional and positional relationships described above have been defined with reference to the specific embodiment of FIGS. 1 and 2, wherein the body of molten aluminum to be treated is contained within a crucible having an axially vertical cylindrical inner wall. It is possible, however, to practice the invention using a crucible or metal-confining vessel with a configuration other than cylindrical and/or an orientation other than vertical, i.e. to perform the process on bodies of molten metal which are initially noncylindrical (in non-stirred condition), especially where the crucible has an essentially continuous rounded sidewall surface free from recesses or abrupt angles that could result in locally stagnant zones within the upwardly spiralling molten metal flow in the peripheral region of the vessel. For example, the vessel may be elliptical (FIG. 3) or bathtub-shaped (FIG. 4) in plan cross section; it may taper downwardly, and may be axially tilted, with an axially vertical stirrer (FIG. 5), or even a tilted stirrer (FIG. 6). A stirrer having a tilted axis of rotation may also be used with a vessel having a vertical geometric axis. Whether the geometric axis of the vessel is vertical or tilted, the rotational axis of the stirrer may have an inclination of up to 15° to the vertical, although a vertical axis of stirrer rotation is preferred because of the effect of gravity on vortex generation. For example, tests of stirrer axis inclination have shown that at an angle of 8° to the vertical, vortex generation (and, consequently, removal of contaminants such as Li and Na) is less efficient than when the axis of rotation is vertical.

For the general case, the aforementioned dimensional and positional relationships can be more broadly defined with reference to the geometric axis of the vessel or crucible (viz., that geometric axis, of the internal volume defined by the vessel, which intersects the quiescent-surface plane of a body of liquid contained therein), the axis of impeller rotation, and the plane of impeller rotation (viz. the plane, containing the midpoint of the impeller blades, perpendicular to the axis of impeller rotation). Thus, the diameter D is the minimum internal diametrical dimension (i.e. measured through the geometric axis of the vessel) of the metal-containing vessel in the plane of impeller rotation. Blade diameter d and eccentricity x are also measured in the plane of impeller rotation, while blade height h, distance y, and distance H are all measured along the axis of impeller rotation, and pitch angle $\theta$ is measured with reference to the axis of impeller rotation.

With the foregoing broadened definitions, all the relationships and ranges of values for the general case (i.e. d/D, h/H, etc.) are as given above for the specific case of an upright cylindrical crucible, except for the outside range of eccentricity x. In general, the eccentricity is limited only by the requirement that the minimum distance C from the axis of impeller rotation to the internal wall of the crucible vessel (again measured in the plane of impeller rotation) is at least equal to D/4. It will be seen that for the case of the upright cylindrical crucible (FIGS. 1 and 2), this lower limiting value of C defines the same outside limit of eccentricity as the previously given upper outside limit of x.

FIGS. 1 and 2 thus illustrate the application of the general dimensional and positional relationships and definitions set forth above to the particular case of an axially vertical cylindrical crucible. As another example, FIG. 3 represents the cross-sectional configuration (in the plane of impeller rotation) of a crucible or vessel 10' having an elliptical cross section containing an axially vertical impeller, or a cylindrical crucible tilted with respect to the impeller axis. In FIG. 3, G is the intersection of the geometric axis of the crucible with the plane of impeller rotation, D is the short diameter of the elliptical cross section, and L is the long diameter of the elliptical cross section. The axis of impeller rotation can intersect the plane of impeller rotation (viz. the plane of the drawing) anywhere within the area enclosed by broken-line ellipse E which is spaced inwardly from the crucible wall by a constant distance $C_o=D/4$. In the illustrated exemplary eccentric position of the impeller shaft 18, the eccentricity x is clearly greater than D/4, but the axis of impeller rotation is spaced from the crucible wall by a distance C greater than D/4.

In FIG. 4, the cross-sectional configuration of the crucible 10'' in the plane of impeller rotation is bathtub-shaped, having semicircular ends and straight parallel sides spaced apart by a distance equal to the diameter of the semicircular ends. The minimum diameter D through the geometric axis G in this plane is the distance between the parallel sides (viz. the diameter of the semicircular ends), while the long diameter L is equal to A+D, where A is the spacing between the centers of the semicircle. The broken line E, defining the outer limit of eccentricity of the axis of impeller rotation, is again spaced inwardly from the crucible wall by a constant distance $C_o=D/4$. The impeller shaft 18 is shown in an illustrative eccentric position within this outer limit, having an eccentricity x.

The crucible 10''' shown in elevational cross section in FIGS. 5 and 6 has a geometric axis G tilted with respect to the vertical. In FIG. 5, the axis of rotation of the impeller 14 is vertical; hence y is a vertical distance (from the midpoint of the impeller blades to the point on the crucible floor vertically beneath that midpoint) and eccentricity x is measured in the horizontal plane P of impeller rotation, which is at an oblique angle to G. In FIG. 6, the axis of rotation of the impeller 14 is tilted to the vertical so as to be parallel to G; y is again measured along the impeller axis, now at an oblique angle to the vertical, and x is measured in rotational plane P which is perpendicular to G but at an oblique angle to the horizontal. The pitch angle $\theta$, as indicated, is in each case measured with reference to the axis of impeller rotation. In both FIGS. 5 and 6, the crucible 10''' tapers so that its cross-sectional diametrical dimensions decrease in a downward direction; the value of diameter D which determines the various aforementioned dimensional relationships is, in each instance, measured in the plane P.

It will be appreciated that a mass of molten metal, held in a tilted cylindrical crucible, assumes an essentially non-cylindrical shape, having an elliptical surface. The top surface of the body of metal in the tilted, tapering crucible of FIGS. 5 and 6 is also ellipsoidal in shape.

By way of further illustration of the invention, reference may be made to the following specific examples, all using equipment of the type shown in FIGS. 1 and 2:

EXAMPLE 1

130 kilogram samples of pure (99.7% by weight) molten aluminum containing between about 20 and 25 p.p.m. Li were treated with solid $AlF_3$ ground to −35 mesh particle size, using each of the following procedures:

A. 300 grams of $AlF_3$ particles delivered to the melt surface, without agitation.

B. 200 grams of $AlF_3$ particles delivered to the melt surface, with the melt agitated by a turbine rotating at 900 r.p.m.; no vortex created.

C. 300 grams of $AlF_3$ particles injected into the melt below the surface through a graphite lance, using nitrogen as the carrier gas.

D. 200 grams of $AlF_3$ particles injected as in C, but with the melt agitated by a turbine (positioned above the lance outlet) rotating at 900 r.p.m.

E. 200 grams (E-1) and 300 grams (E-2) of particles delivered to the melt surface while a stable vortex is generated and maintained in the melt, by a stirrer rotating at 225 r.p.m., in accordance with the present method.

In a further procedure (F), no $AlF_3$ was used, but the melt was agitated (without creation of a vortex) by the turbine, again rotating at 900 r.p.m. Results were as follows:

| | Li (p.p.m.) remaining after treatment time of: | | | | |
|---|---|---|---|---|---|
| Procedure | 0 min. (start) | 3 min. | 6 min. | 9 min. | 12 min. |
| A | 24 | 14 | 9 | 6 | 4 |
| B | 22 | 10 | 7 | 5 | 3 |
| C | 23 | 9 | 4 | 2 | 1 |
| D | 15 | 7 | 2 | 1 | 1 |
| E-1 | 20 | 2 | 2 | 1 | 1 |
| E-2 | 24 | 3 | 2 | 1 | 1 |
| F | 22 | 16 | 14 | 12 | 11 |

The procedures embodying the present method (E-1 and E-2) achieved significantly more rapid reduction in lithium content than any other procedures, and the lithium level reached after nine minutes (1 p.p.m.) with the procedures of the present method was equalled only by the procedure (D) involving combined use of injection and agitation, wherein the initial level of lithium contamination was much lower.

EXAMPLE 2

Using equipment including a cylindrical crucible having an internal diameter of 64 inches with a nominal capacity of 10,000 lbs. of molten aluminum, a series of quantities of molten aluminum contaminated with lithium and sodium were treated in accordance with the present method. In each instance, the crucible was filled to a depth of 40 inches with the molten aluminum, and 15 lbs. of $AlF_3$ powder (equivalent to about 1.7 kg per metric tonne of aluminum) were supplied to the molten aluminum surface. A pitched-bladed impeller having a blade height of 10 inches and diameter of 18 inches was immersed in the molten aluminum with an eccentricity of between 12 and 15 inches measured from the vertical central axis of the crucible, and with the center of the impeller blades 15 inches above the crucible bottom, such that the top edges of the blades were located halfway between the top of the melt and the crucible bottom (the blades thus being disposed entirely within the lower half of the molten metal body); the impeller was rotated, in each case, for 10 minutes at a rate of between about 130 and about 135 r.p.m., to create and maintain a stable vortex. The mode of addition of $AlF_3$ particles, and the molten metal temperature, were varied from test to test. Results of twenty successive tests were as follows:

| Addition mode of $AlF_3$ to metal surface** | Lithium (p.p.m.) Start | After 10 min. | % Removed | Sodium (p.p.m.) Start | After 10 min. | % Removed | Metal temperature (°C.) |
|---|---|---|---|---|---|---|---|
| a | 19.9 | 0.9 | 95 | 63 | <1 | ~100% | 743 |
| a | 16.2 | 1.1 | 93 | 43 | <1 | ~100% | 780 |
| b | 19.7 | 0.5 | 97 | 42 | <1 | ~100% | 705 |
| b | 18.1 | 1.0 | 94 | 35 | <1 | ~100% | 765 |
| b | 18.5 | 0.4 | 98 | 33 | <1 | ~100% | 735 |
| b | 20.6 | 0.8 | 96 | 47 | <1 | ~100% | 720 |
| b | 15.4 | 0.3 | 98 | 39 | <1 | ~100% | 722 |
| b | 15.7 | 0.9 | 94 | 39 | <1 | ~100% | 720 |
| b | 14.9 | 1.3 | 91 | 44 | <1 | ~100% | 800 |
| b | 12.1 | 1.4 | 88 | 31 | <1 | ~100% | 725 |
| b | 21.0 | 0.5 | 98 | 61 | <1 | ~100% | 730 |
| c | 16.5 | 1.2 | 93 | 28 | <1 | ~100% | 745 |
| d | 21.2 | 1.0 | 95 | 48 | <1 | ~100% | 785 |
| d | 19.8 | 2.4 | 88 | 58 | 1 | ~100% | 870 |
| e | 17.7 | 1.7 | 90 | 32 | <1 | ~100% | 810 |
| f | 16.7 | 1.2 | 93 | 41 | <1 | ~100% | * |
| f | 17.6 | 1.6 | 91 | 42 | <1 | ~100% | * |
| g | 6.8 | 0.8 | 88 | 7 | <1 | ~100% | * |
| g | 13.2 | 2.3 | 83 | 43 | 2 | ~100% | * |
| g | 16.8 | 1.7 | 90 | 35 | <1 | ~95% | * |

*not measured

**a - 50% of $AlF_3$ added at start, 50% added after 1 minute of impeller operation b - 33% added at start, 33% after 30 seconds, 33% after 1 minute of impeller operation c - continuous feed for 1.5 minutes from start of impeller operation d - continuous feed for 1.0 minutes from start of impeller operation e - continuous feed for 0.5 minutes from start of impeller operation f - 33% added at start, 33% after 15 seconds, 33% after 30 seconds of impeller operation g - 33% added at start, 33% after 10 seconds, 33% after 20 seconds These data illustrate the adverse effect of increased metal temperature on efficiency of lithium removal, attributable to a thermodynamically controlled lithium equilibrium between the fluoride material and the metal which prevents 100% efficient lithium removal from the hot metal; a similar effect could not be observed for sodium because of the higher vapor pressure of sodium, which assists in its removal.

The average lithium removal efficiency, after 10 minutes' treatment time, was 93% for the twenty tests included in the foregoing table. This corresponds to a lithium level (for the treated metal) which is satisfactory, i.e. below the maximum acceptable limit, for most purposes.

EXAMPLE 3

Several series of treatments were performed in potroom transfer crucibles on aluminum which had been siphoned into the crucibles from electrolytic reduction cells. The aluminum fluoride powder used (92% $AlF_3$, about 8% $Al_2O_3$ by weight) had a bulk density of 1.5–1.7 g/cm$^3$ and a particle size distribution as follows: 25% larger than 100 microns, 50% larger than 80 microns, 75% larger than 65 microns. In these treatments, the crucibles contained approximately 3,500 kg. of molten aluminum each. A three-bladed impeller having a blade pitch (angle $\theta$) of 35°, diameter (d) of 46 cm., and blade height (h) of 25 cm. was employed, and rotated to establish and maintain a stable vortex; the ratios d/D and h/H were each 0.25, and the maximum treatment time was six minutes. The rotor eccentricity (x) was d/2. Several crucibles were treated in each series. For purposes of comparison, one series (Series 1) was run without use of aluminum fluoride. The remaining six series of treatments embodied the process of the invention. In series 2–5, all the aluminum fluoride was added at or before the start of stirring; in series 6 and 7, one-third of the aluminum fluoride was added at the start, one-third after one-half minute, and one-third after one minute of stirring. The metal in the crucibles of series 7 initially contained 101 p.p.m. of magnesium; the metal in the other six series contained less than 10 ppm magnesium.

Results were as follows:

| Test Series No. | Number of Treated Crucibles | Quantity of Added $AlF_3$ lb | Quantity of Added $AlF_3$ kg$AlF_3$/metric tonne Al | Stirring Speed (r.p.m.) | Metal Temperature (°C.) | Analytical Results: Lithium start ppm | Lithium 3 min. ppm | Lithium 3 min. % Removal | Lithium 6 min. ppm | Lithium 6 min. % Removal | Sodium start ppm | Sodium 3 min. ppm | Sodium 3 min. % Removal | Sodium 6 min. ppm | Sodium 6 min. % Removal | Calcium start ppm | Calcium 3 min. ppm | Calcium 6 min. ppm |
|---|---|---|---|---|---|---|---|---|---|---|---|---|---|---|---|---|---|---|
| 1 | 7 | 0 | 0 | 175 | 811 | 21 | 17.9 | 15% | 17 | 19% | 54 | 21 | 61% | 15 | 72% | 2 | 1 | <1 |
| 2 | 10 | 5 | 0.7 | 100 | 771 | 17.9 | 10.2 | 43% | 8.0 | 55% | 36 | 8.7 | 76% | 4.9 | 86% | 3 | 1 | <1 |
| 3 | 11 | 15 | 2.0 | 100 | 744 | 18.1 | 7.6 | 58% | 4.7 | 74% | 30 | 6.8 | 77% | 3.2 | 89% | 3 | 2 | <1 |
| 4 | 4 | 25 | 3.3 | 100 | 759 | 15.0 | 5.3 | 65% | 3.3 | 78% | 34 | 6.5 | 81% | 3.3 | 90% | 2 | 1 | <1 |
| 5 | 4 | 15 | 2.0 | 150 | 752 | 18.5 | 6.6 | 64% | 2.7 | 85% | 42 | 7.1 | 83% | 3.2 | 92% | 3 | 1 | <1 |
| 6 | 7 | 15 | 2.0 | 175 | 765 | 17.0 | 5.5 | 68% | 2.2 | 87% | 37 | 6.6 | 82% | 1.5 | 96% | 2 | 1 | <1 |
| 7 | 7 | 15 | 2.0 | 175 | 780 | 14.1 | 5.1 | 64% | 2.4 | 83% | 37 | 7.2 | 81% | 2.5 | 93% | 2 | 1 | <1 |

Series 1 illustrates the removal of alkali metals due to the aluminum stirring effect only. The greater sodium removal after 3 and 6 minutes (61% and 72%) compared to the lower lithium removal efficiency (15% and 19%) is attributable to the much lower vapor pressure of lithium than sodium. In effect, sodium has a boiling temperature at atmospheric pressure of 882° C. vs. 1,329° C. for lithium. Consequently, the oxidation of sodium (to give sodium oxide which accumulates at the melt surface) is responsible for the faster sodium metal concentration decrease in molten aluminum.

Series 2, 3 and 4 compare the effect of the $AlF_3$ quantity on sodium and lithium removal. It can be seen that increasing the ratio kg $AlF_3$/metric tonne Al from 0.7 to 3.3 had a marked effect on lithium removal. The effect is not so apparent for sodium due to the aforementioned comparatively faster sodium removal by oxidation only.

Series 5 is identical to series 3 except for an increased r.p.m. from 100 to 150. This increased the sodium and lithium removal efficiency from 89% to 92% and from 74% to 85%, respectively. Series 6 illustrates, for 7 transfer crucibles, the influence of a sequential addition of $AlF_3$ powder on the removal rate of alkali metals. It can be seen that this also helps in increasing the removal rate, probably by increasing the interfacial area between the powder and the aluminum (the addition of a large quantity of $AlF_3$ in one "shot" can cause powder agglomeration and decrease the effective contact with the aluminum).

Series 7 illustrates the influence of Mg metal present in addition to Li, Na and Ca. The Mg content after 3 minutes stirring was 46 p.p.m. (54% removal) and after 6 minutes was 30 p.p.m. (70% removal). It can be concluded that the presence of Mg, even in a concentration larger than other alkali metals, does not significantly affect process efficiency. The presence of Mg in these tests was due to the use of a mixed LiF-$MgF_2$ electrolyte in the reduction cells. The presence of magnesium in the metal due to other causes (e.g. contamination from Al-Mg alloys) could also be tolerated. However, if Mg concentration increases, the addition of $AlF_3$ would have to be adjusted accordingly, to ensure a constant lithium and sodium removal efficiency.

EXAMPLE 4

In two further series of tests using the same equipment as in Example 3, groups of transfer crucibles each containing about 3,400 kg. of molten aluminum were treated in accordance with the present method. Fifteen lbs. of the same $AlF_3$ powder as in Example 3 (2.0 kg. $AlF_3$/metric tonne Al) were added to each crucible in three equal 5-lb. increments, viz. at the start, after 30 seconds of stirring, and after one minute of stirring. The stirring was performed for six minutes at 175 r.p.m., producing and maintaining a stable vortex. The treated metal from one series was used to prepare a first alloy (having the Aluminum Association designation AA-1350) and the treated metal of the second series was used to prepare a second alloy (Aluminum Association designation AA-5154). Alkali metal and alkaline earth metal content was measured again after alloying. Results were as follows:

| Alloy Prepared | Total Metal Weight Treated (metric tonnes) | Average Analysis: Before Treatment ppm | After Treatment ppm | % Removal | Before Casting (after Alloying) ppm |
|---|---|---|---|---|---|
| AA-1350 | 7.1 | Na - 29 | 1.7 | 94% | <1 |
| | (21 crucibles) | Li - 17 | 2.6 | 85% | 0.2 |
| | | Ca - 2 | <1 | | <1 |
| AA-5154 | 85 | Na - 37 | 2.1 | 94% | <1 |
| | (25 crucibles) | Li - 17 | 2.7 | 84% | 0.6 |
| | | Ca - 3 | <1 | | <1 |

It can be seen that the efficiency is of the same order as in Series 6 of Example 3. It can also be concluded that the sodium and lithium concentration continues to decrease after the treatment. This can be attributed to various metal operations and treatment (transfer, alloying, stirring, heating, holding, etc.) which accelerate the oxidation of alkali metals in the furnace.

EXAMPLE 5

Again using the same equipment and the same $AlF_3$ powder as in Examples 3 and 4, molten aluminum in transfer crucibles each containing 3,500 kg. of aluminum was stirred for 10 minutes at 100 r.p.m., a stable vortex being created and maintained. After treatment, the metal stood for 10 minutes and the alkali metal content was remeasured. Results were as follows:

| Test No. | $AlF_3$ (lb) | Temp. (°C.) | | Analysis: During Treatment (Min.) Start | 6 | 10 | 10 min. after Treatment |
|---|---|---|---|---|---|---|---|
| A | 15 | 760 | Li | 18.3 | 6.0 | 3.6 | 3.1 |
| | | | Na | 43 | 9.0 | 4.0 | 3 |
| B | 20 | 825 | Li | 15 | 4.3 | 2.7 | 2.5 |
| | | | Na | 40 | 5 | 2 | 1 |

The observed further decrease in alkali metal content after stirring was ended may be explained by the high level of activity of the $AlF_3$-rich reaction products in contact with molten aluminum. Even if this alkali metal decrease on standing after treatment is not significantly important as compared to the reduction during the treatment itself, it nevertheless indicates that there is no risk of back-reaction (alkali metal pick-up) during the transfer crucible holding or waiting period between the treatment and the transfer to the casting furnace. This would not be the case if the alkali metal were removed using a treatment with chlorine gas reaction only.

EXAMPLE 6

To illustrate the effect of blade angle, a series of tests were performed on 125 kg. samples of molten aluminum of 99.7% purity at a temperature of 825° C., using −35 mesh aluminum fluoride powder in a proportion of 0.8 kg./metric tonne Al. Impellers with blades of various pitches were employed; in each case, d=12.5 cm, h=11 cm, d/D=0.25, h/H=0.25, and x=d/2. Stirring was performed for six minutes at 250 r.p.m. Results were as follows:

| Number of Blades | Angle to Vertical θ | Lithium Concentration ppm (% Removal) Stirring Time-Min. Start | 3 | 6 |
|---|---|---|---|---|
| 4 | 0° | 27 | 13 (52%) | 11 (60%) |
| 4 | 30° | 40 | 12 (70%) | 8 (80%) |
| 4 | 35° | 26 | 5 (81%) | 3.5 (86%) |
| 4 | 45° | 26 | 4 (85%) | 3 (88%) |
| 3 | 35° | 26 | 4 (85%) | 1 (96%) |

Increase in pitch angle increased the percentage removal of Li after three and six minutes, and the number of blades appeared also to affect the removal efficiency.

EXAMPLE 7

A synthetic mixture containing 50% each (by weight) of cryolite ($Na_3AlF_6$) and $AlF_3$ (weight ratio of $NaF/AlF_3$=0.43) was prepared by fusion of the two compounds, ground to −35 mesh particle size, and employed for treatment of molten aluminum in accordance with the present method. Two 150 kg. samples of aluminum, both at 825° C., were treated, using a stirrer having four blades with a pitch angle θ of 30°, diameter (d) of 12.5 cm., blade height h of 11 cm., in a crucible so dimensioned that the ratios d/D and h/H were each equal to 0.25; one of the two tests employed a fluoride-containing material constituted of 85% $AlF_3$, 15% by weight, and the other employed the aforementioned cryolite-$AlF_3$ mixture, both in a proportion of 2.0 kg per metric tonne of aluminum. Results were as follows:

| $AlF_3$-containing material | Lithium Concentration (ppm) vs. Stirring Time (min.) Start | 1 | 2 | 3 | 4 | 5 |
|---|---|---|---|---|---|---|
| 85% $AlF_3$, 15% $Al_2O_3$ | 21 | 6.3 | 3.8 | 2.5 (88%) | 1.5 | 1.0 (95%) |
| 50% $AlF_3$/ 50% $Na_3AlF_6$ | 30 | 7.5 | 3.6 | 2.4 (92%) | 1.5 | <1 (>97%) |

The high efficiency of the $AlF_3/Na_3AlF_6$ mixture is possibly attributable to the formation of low melting point (about 700° C.) phases. It therefore melts after contact with the liquid aluminum providing a liquid-liquid reaction rather than the solid-liquid reaction with the $AlF_3$ powder which compensates for the aluminum fluoride dilution.

In addition, aluminum fluoride powder in mixtures of a wide range of particle size distribution have been used, with the average particle size dimension varying between 1 and 0.05 mm.

It can be concluded that the treatment of molten aluminum directly in the transfer crucibles in accordance with the present method permits the utilization of a larger range of fluoride material than is possible in the previously known filter bed techniques, which require utilization of fluoride granules of strictly limited size and shape for efficient contact during the metal filtration It is to be understood that the invention is not limited to the features and embodiments hereinabove specifically set forth, but may be carried out in other ways without departure from its spirit.

I claim:

1. A method of removing contaminant alkali metals and alkaline earth metals from aluminum by bringing the aluminum, in molten state having the contaminants dissolved therein, into contact with particulate aluminum-fluoride-yielding material, said method comprising:

(a) delivering said particulate material to the surface of a body of the molten aluminum contained in a vessel having a geometric axis, (b) stirring the molten body for creating and maintaining a vortex therein to draw the delivered particulate material into mixture with the molten aluminum, thereby to effect reaction of the particulate material with the dissolved contaminants, the stirring step being performed by rotating, in a plane of rotation and about an axis of rotation, an impeller having a plurality of blades immersed in the molten body, (c) continuing the stirring of the molten body until the content of said dissolved contaminants therein is reduced at least to a predetermined low level, and (d) separating the molten aluminum of the body from products of reaction of the contaminants with the fluoride;

(e) wherein the vessel has a minimum internal diameter D, and is filled with the molten body to a height H, and the impeller has a diameter d and a blade height h, such that the ratio d/D is between 0.1 and 0.6 and the ratio h/H is between 0.1 and 0.7, D and d being measured in the plane of impeller rotation, and H and h being measured along the axis of impeller rotation.

2. A method according to claim 1, wherein said impeller blades are pitched, each having a major surface facing downwardly at an acute angle to the axis of rotation of the impeller, and wherein the direction of rotation of the impeller is such that said major surfaces are the leading surfaces of the blades.

3. A method according to claim 1 or 2, wherein the axis of rotation of the impeller is disposed eccentrically with respect to the geometric axis of the vessel in the plane of rotation of the impeller.

4. A method according to claim 1, wherein the axis of impeller rotation is spaced from said geometric axis by a distance x measured in the plane of rotation of the impeller and the minimum spacing between said axis of rotation and the vessel wall measured in said plane of rotation is at least D/4, and wherein said blade major surfaces are pitched at an angle $\theta$ to the axis of impeller rotation between 0° and 45°, at least one of x and $\theta$ being greater than zero.

5. A method according to claim 4, wherein the midpoint of said blades is spaced above the bottom of said vessel by a distance y, measured along said axis of rotation, between 0.25 H and 0.75 H.

6. A method according to claim 5, wherein the ratio d/D is between 0.15 and 0.40, the ratio h/H is between 0.2 and 0.40, x is between 0 and d/2, y is between 0.4 H and 0.6 H, and $\theta$ is between 30° and 40°.

7. A method according to claim 4, wherein the number of said blades is three and $\theta$ is between 30° and 35°.

8. A method according to claim 1, wherein d/D is between 0.15 and 0.40 and the impeller is rotated at a rate between 100 and 300 r.p.m.

9. A method according to claim 1, wherein said material is delivered to the molten body over a period of time continuing after initiation of the stirring step.

10. A method according to claim 1, wherein said stirring step comprises rotating said impeller about a substantially vertical axis.

11. Apparatus for mixing particulate aluminum-fluoride-yielding material with molten aluminum to remove dissolved contaminant alkali metals and alkaline earth metals from the molten aluminum, said apparatus comprising (a) a vessel, having a cylindrical internal wall with a vertical geometric axis and an internal diameter D, for containing a body of molten aluminum to a height H above the floor of the vessel; and (b) a stirrer comprising an impeller having a plurality of blades disposed for immersion in a body of molten aluminum contained within the vessel and means for rotating the impeller about a substantially vertical axis, said impeller having a diameter d and said blades having a height h, the midpoint of said blades being spaced above the floor of the vessel by a distance y, the axis of impeller rotation being spaced from said geometric axis by a distance x, and said blades having major surfaces pitched downwardly at an angle $\theta$ to the vertical;

(c) the values of d, D, h, H, x, and $\theta$ being such that d/D is between 0.1 and 0.6, h/H is between 0.1 and 0.7, x is between 0 and D/4, y is between 0.25 H and 0.75 H, and $\theta$ is between 0° and 45°, at least one of x and $\theta$ being greater than zero.

12. Apparatus as defined in claim 11, wherein both x and $\theta$ are greater than zero.

13. Apparatus as defined in claim 12, wherein d/D is between 0.15 and 0.40, h/H is between 0.2 and 0.40, x is not greater than d/2, y is between 0.4 H and 0.6 H, and $\theta$ is between 30° and 40°.

14. Apparatus as defined in claim 13, wherein $\theta$ is between 30° and 35° and the number of said blades is three.

15. Apparatus for mixing particulate aluminum-fluoride-yielding material with molten aluminum to remove dissolved contaminant alkali metals and alkaline earth metals from the molten aluminum, said apparatus comprising (a) a vessel, having a geometric axis, for containing a body of molten aluminum; and (b) a stirrer comprising an impeller having a plurality of blades disposed for immersion in a body of molten aluminum contained within the vessel and means for rotating the impeller in a plane of rotation containing the midpoint of the impeller blades and intersecting said geometric axis, said impeller having a diameter d and said blades having a height h, the midpoint of said blades being spaced above the floor of the vessel by a distance y, the axis of impeller rotation being spaced from said geometric axis by a distance x, and said blades having major surfaces pitched downwardly at an angle $\theta$ to the axis of rotation of the impeller, d and x being measured in said plane of rotation and h and y being measured along said axis of rotation;

(c) said vessel having a minimum internal diameter D in said plane of rotation and being adapted to contain molten aluminum to a height H above the floor of the vessel measured along said axis of rotation;

(d) the values of d, D, h, H, and $\theta$ being such that d/D is between 0.1 and 0.6, h/H is between 0.1 and 0.7, y is between 0.25 H and 0.75 H, and $\theta$ is between 0° and 45°, at least one of x and $\theta$ being greater than zero, and the minimum spacing between said axis of rotation and the wall of said vessel being at least D/4 measured in said plane of rotation.

16. Apparatus as defined in claim 15, wherein both x and $\theta$ are greater than zero.

17. Apparatus as defined in claim 16, wherein d/D is between 0.15 and 0.40, h/H is between 0.2 and 0.40, x is not greater than d/2, y is between 0.4 H and 0.6 H, and $\theta$ is between 30° and 40°.

18. Apparatus as defined in claim 17, wherein $\theta$ is between 30° and 35° and the number of said blades is three.

19. Apparatus as defined in claim 15, wherein said rotating means comprises means for rotating said impeller about a substantially vertical axis.

20. A method of removing contaminant alkali metals and alkaline earth metals from aluminum by bringing the aluminum, in molten state having the contaminants dissolved therein, into contact with particulate aluminum-fluoride-yielding material, said method comprising:

(a) delivering said particulate material to the surface of a body of the molten aluminum, (b) stirring the molten body for creating and maintaining a vortex therein to draw the delivered particulate material into mixture with the molten aluminum, thereby to effect reaction of the particulate material with the dissolved contaminants, (c) continuing the stirring of the molten body for a period of time, not more than about ten minutes, until the content of said dissolved contaminants therein is reduced at least to a predetermined low level, and (d) separating the molten aluminum of the body from products of reaction of the contaminants with the fluoride.

* * * * *